United States Patent [19]

Kirkel

[11] 4,145,005

[45] Mar. 20, 1979

[54] ONE-PIECE POWDER BUTTON

[75] Inventor: David Kirkel, Mount Prospect, Ill.

[73] Assignee: Seaquist Valve Company, Cary, Ill.

[21] Appl. No.: 819,336

[22] Filed: Jul. 27, 1977

Related U.S. Application Data

[63] Continuation-in-part of Ser. No. 631,668, Nov. 13, 1975, abandoned.

[51] Int. Cl.[2] ..... B65D 83/06

[52] U.S. Cl. ..... 239/573; 239/579; 239/601

[58] Field of Search ..... 239/337, 573, 579, 601, 239/492; 222/402.1

[56] References Cited

U.S. PATENT DOCUMENTS

| | | | |
|---|---|---|---|
| 2,818,202 | 12/1957 | Abplanalp | 239/573 X |
| 2,883,089 | 4/1959 | Kiraly | 239/573 X |
| 3,299,960 | 1/1967 | Stern | 239/337 X |
| 3,482,784 | 12/1969 | Webster | 239/337 X |
| 3,512,720 | 5/1970 | Platt | 239/573 X |
| 3,583,642 | 6/1971 | Crowell et al. | 239/337 |
| 4,030,667 | 6/1977 | Le Guillou | 239/573 |

*Primary Examiner*—Robert B. Reeves
*Assistant Examiner*—Andres Kashnikow
*Attorney, Agent, or Firm*—Stein & Frijouf

[57] ABSTRACT

A valve button of the type used primarily with an aerosol dispenser comprising a body having a valve stem recess for mounting on a substantially conventional valve stem associated with an aerosol dispenser valve assembly. The body has integrally formed therein an enlarged expansion chamber disposed in direct communicating relation with a terminal orifice passage which defines the exclusive path of travel of the product and expended propellant issued from the button. The terminal orifice passage has a predetermined shortened longitudinal dimension and a stepped configuration wherein the terminal orifice passage terminates in a recessed face portion formed in the outer wall portion of the button. The structural components comprising the button and the dimensions of the terminal orifice passage insure proper evaporation of the propellant as well as immediate dispensing thereafter to produce a desired spray pattern characteristics along with maintenance of a desirable surface temperature of the product being dispensed.

11 Claims, 4 Drawing Figures

FIG. 1
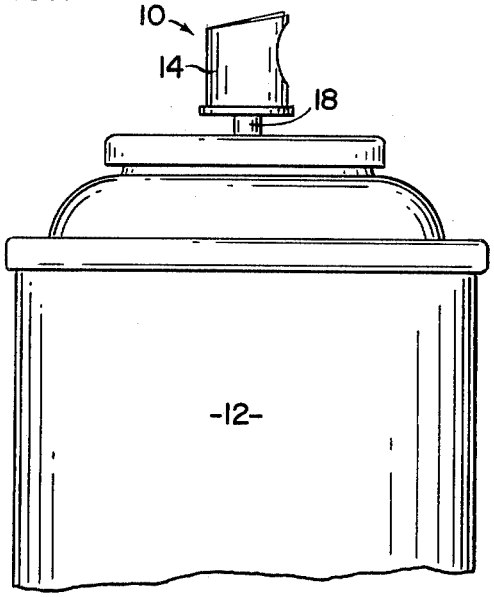
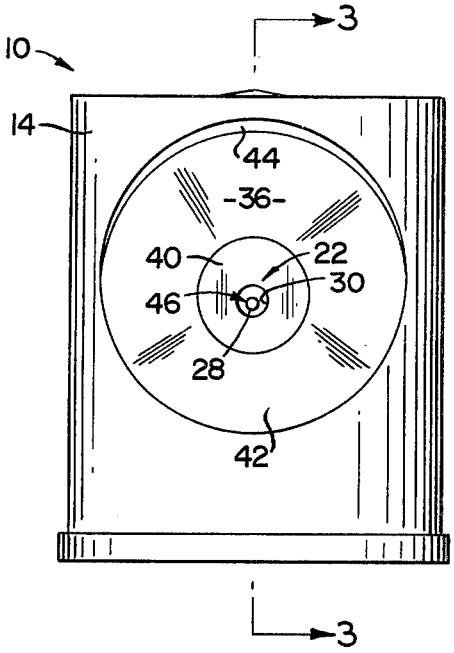
FIG. 2
FIG. 3
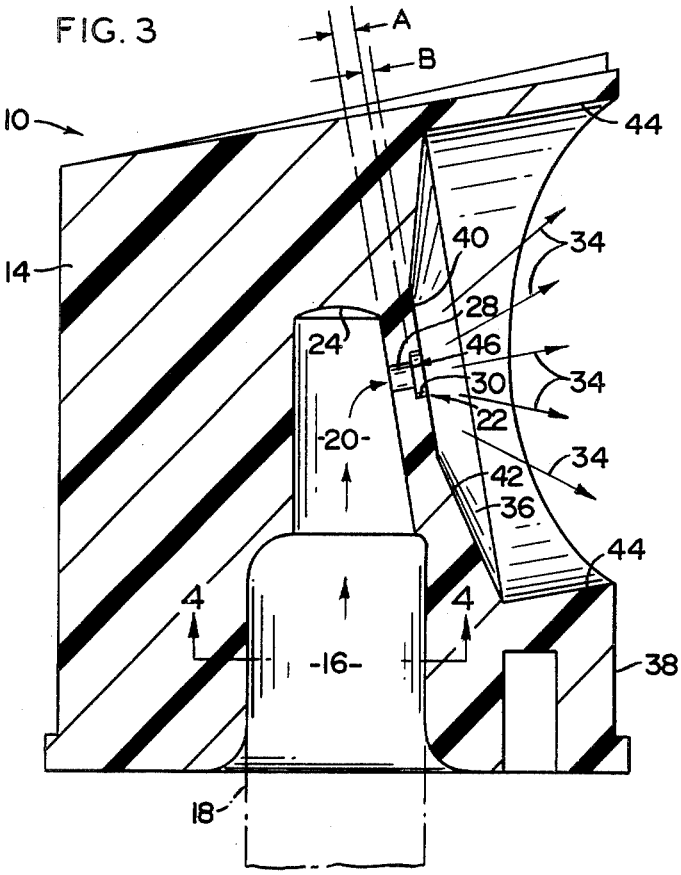
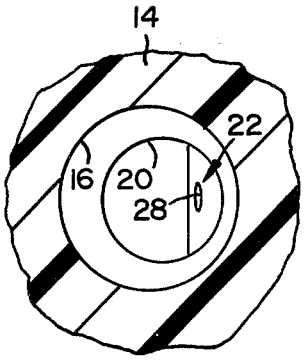
FIG. 4

ONE-PIECE POWDER BUTTON

CROSS REFERENCE TO RELATED APPLICATION

This is a continuation-in-part of application Ser. No. 631,668 filed Nov. 13, 1975, now abandoned.

BACKGROUND OF THE INVENTION

1. Field of the Invention

This invention relates to a valve button of the type primarily used with an aerosol dispenser having an expansion chamber disposed in direct communication with a terminal orifice passage wherein the relative disposition, dimension and configuration of the expansion chamber and passage produces a superior spray pattern of the product being dispensed.

2. Description of the Prior Art

A constant consideration in the design of various structural components which comprise an aerosol dispenser, a valve mechanism or valve button, is the accomplishment of certain pattern characteristics of the product being dispensed from the button. These desired characteristics of course depend upon the particular properties of the product being dispensed. In the aerosol dispensing industry, it is well recognized that patterns of dispensed aerosol products range from a light mist-type pattern to a relatively solid homogeneous pattern for the heavier products. Naturally, pattern characteristics may vary depending upon the particular application for which the product is being utilized.

In attempting to design structural components associated with an aerosol dispenser, it is well recognized that certain heavier products must first be broken up into a substantially mist-like consistency. Prior art structures have attempted to accomplish this breakup through the use of mechanical inserts placed directly into the body of a valve button. Valve buttons having such inserts connected thereto are commonly referred to as mechanical breakup buttons, two piece buttons or some similar terminology.

There are numerous designs in the aerosol industry for such mechanical breakup buttons or actuators for aerosol valves. Generally, such buttons or actuators comprise structures specifically configured to impart a swirling action to the product prior to leaving the terminal orifice. In this manner, the swirling action of the product creates an actual mechanical breakup wherein specifically the propellant used in combination with the product and maintained within the aerosol dispenser is allowed to evaporate prior to being dispensed. This has a desired effect on the temperature of the actual product being dispensed in that such temperature is prevented from becoming too low. It is obvious and well known that dispensed products having undesirably low temperatures become uncomfortable to the user, thereby rendering the entire aerosol product generally undesirable for use to the consuming public.

It can readily be seen therefore that the maintenance of the desired temperature of the dispensed product plus the accomplishment of a spray pattern having desired pattern characteristics is highly desirable and is directly dependent upon the structure of the aerosol button or the structural design of the other components comprising the delivery assembly for the aerosol dispenser. When dealing with relatively heavier products, such as a powder-like product, desired spray pattern characteristics include the delivery of a dry, misty spray again having a desired temperature. Similarly, when attempting to dispense alcohol based products from an aerosol dispenser, it has been found that valve buttons and certain valve assemblies associated with the dispenser must be of certain rather complex structure in order to accomplish the desired spray pattern.

In order to overcome the above set forth problems in the aerosol industry and accomplish the desired result when dispensing various types of products, valve buttons, in particular, have been designed which are generally structured to be two piece buttons wherein the button body has an insert or like member mounted therein. The structural features of such a button, while certainly operable when utilizing certain products, are generally considered to be extremely complex in design and manufacture. This of course necessarily adds to the overall expense of manufacture and sometimes leads to questionable reliability when the structural features of the valve button or other parts of the valve assembly are unnecessarily complex and intricate.

Therefore, it is readily seen that there is a great need in the aerosol industry for a valve button having certain structural features which are simple of design and preferably of an integral one piece structure. Such a simplified valve button should be further capable of accomplishing the desired pattern characteristic and also the maintenance of the desired temperature of the product ultimately being dispensed from the button.

SUMMARY OF THE INVENTION

This invention relates to a valve button of the type used primarily with aerosol dispensers. Conventionally, aerosol dispensers have a propellant and the product to be dispensed both maintained under pressure within the dispenser itself. Movement of the valve button actuates the valve assembly associated with the dispenser, causing a mixture of product and propellant to flow into the valve button and be dispensed in a desired pattern.

The present invention is related to a valve button including a body having a stem recess and designed to receive a valve stem of generally conventional design. The disposition of the stem recess is such as to dispose the interior of the body of the valve button in fluid communicating relation with the interior of the aerosol dispenser so that product and propellant may flow into the button.

The structure of the present invention is also applicable to a valve button having what may be termed a "male" configuration. More specifically, instead of providing a valve button with a stem recess, the subject invention could be applied to a valve button wherein the valve stem is integrally attached to the valve button. In this embodiment the valve button does not include the stem recess per se since the stem is integrally attached thereto.

In the preferred embodiment of the present invention, the valve body is formed into an integral one piece unit. An expansion chamber having a substantially enlarged configuration is disposed in direct communication with the valve stem recess so as to receive the product and propellant issuing from the valve stem. Alternatively, the expansion chamber is disposed in direct communication with the integrally attached valve stem of the "male" configuration.

The enlarged dimension and configuration of the expansion chamber allows the "flash" of the propellant. As is well recognized in the art, the term "flash" may be used to describe the rapid expansion and evaporation of the propellant as the propellant leaves the valve stem and enters the expansion chamber. This evaporation of the propellant within the chamber of the valve body prior to being dispensed has a desired effect on the temperature of the product issued from the valve button. It is well recognized that the surface temperature of the product being dispensed has a certain desirable range. In the prior art valve button assemblies, evaporation and expansion of the propellant prior to actually issuing from the valve button is provided by a breakup insert or like structure thereby necessitating the production of a two piece valve button.

The valve button structure of the present invention further comprises a terminal orifice means including a passage integrally formed in the valve button in contiguous relation to the expansion chamber. The terminal end of the passage is preferably disposed in contiguous relation with a recess formed on the external surface of the valve button. The disposition of the terminal orifice passage defines the exclusive passageway of the product and propellant flowing into the expansion chamber and issuing from the valve button.

An important feature of the preferred embodiment of the present invention comprises the passage of the terminal orifice having a longitudinal dimension in the range of from 0.015 inches to 0.025 inches. Optimum results have been found in the range of 0.015 to 0.020 inches. The terminal orifice passage is further defined by a first linear portion and a second stepped portion wherein the first linear portion has a longitudinal dimension greater than, and a transverse dimension lesser than, the stepped portion.

In the preferred embodiment, the first linear portion of the terminal orifice passage is defined in contiguous relation with the enlarged expansion chamber. The stepped portion is disposed in interconnecting relation with the first linear portion and the exterior portion whereby the distal end of the passage and therefore the stepped portion is contiguous to the face of the button.

In order to avoid product impingement on the exterior portion of the button it is preferred that the face of the button be recessed from the exterior wall portion of the button. A surrounding lip is preferably spaced from the terminal orifice of the button.

It should be emphasized that the structure of the valve button set forth above allows the delivery of a spray pattern that is wider, warmer and less dense. These desirable characteristics are obtained, at least in part, due to the rapid "flashing" of the propellant because of the length and configuration of the terminal orifice as well as other structural features defined herein.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a side view showing the valve button mounted on an aerosol dispenser of substantially conventional design and structure;

FIG. 2 is a front exterior view of the recessed face portion of the present invention;

FIG. 3 is a sectional view taken along line 3—3 of FIG. 2 showing the interior of the valve button; and FIG. 4 is a sectional view taken along line 4—4 of FIG. 3 showing the interior of the valve stem recess and expansion chamber and its relation to the terminal orifice passage.

Similar reference characters refer to similar parts throughout the several views of the drawings.

DETAILED DESCRIPTION

As shown in FIGS. 1, 2 and 3, the present invention is directed to a valve button 10 of the type utilized with an aerosol dispenser generally indicated as 12 (FIG. 1). It should be noted that the preferred embodiment of the valve button structure will be described with specific reference to an aerosol dispenser. However, the aerosol dispenser itself does not form any specific part of the present invention.

The valve button 10 includes a body 14 having integrally formed therein a valve stem recess 16. The recess 16 is designed and configured to mount button body 14 on a valve stem 18 (FIGS. 1 and 3).

Alternately, in another embodiment of the present invention, the valve stem recess per se may be eliminated. In this embodiment the valve button may have the valve stem integrally attached thereto and thereby define a "male" type configured button.

An expansion chamber 20 is integrally formed on the interior of button 14 in direct fluid communication with the stem recess 16 or with an integrally formed valve stem, dependent upon the embodiment of the present invention utilized. This allows fluid communication between the interior of dispenser 12 and the button body 14 and more specifically the expansion chamber 20. The expansion chamber itself comprises an enlarged configuration and is disposed in direct communication with the terminal orifice means generally indicated as 22 (FIG. 3). The expansion chamber 20, as set forth above, is disposed and configured to allow "flash" of the product as it immediately issues from the stem positioned within the stem recess 16. This enlarged configuration allows for the rapid evaporation of the product prior to being dispensed through the terminal orifice passage 22. As is well known in the art, this evaporation prior to dispensing causes a "warming" of the actual product being dispensed or the maintaining of the temperature of the dispensed product above a desired temperature range. In order to accomplish this "flash" or rapid evaporation, the configuration of the chamber 20 must be such as to provide adequate space for expansion and, evaporation. Accordingly, one embodiment of the present invention comprises a substantially domed configuration 24 defining the upper portion of the chamber 20. This domed upper cap portion is disposed in spaced relation to the terminal orifice passage 22.

Turning to the structure of the terminal orifice passage, it should be noted that in conventional aerosol dispenser buttons the terminal orifice passage is usually defined by a longitudinal dimension of 0.025 to 0.050 inches. In the present invention, an important factor of the disclosed structure is that the longitudinal dimension of the passage 22 is preferably in the range of 0.015 to 0.025 inches. Furthermore, the dispostion of the passage 22 is such as to be in direct communication with the expansion chamber 20 and in contiguous relation with the exterior of the button 14. The terminal orifice passage 22 itself comprises a first linear portion 28 and a second stepped portion 30. With specific reference to FIG. 3, the longitudinal dimension of the first portion 28 is designated "A" and is ideally approximately 0.010 to 0.015 inches. Similarly, the longitudinal dimension of the second step portion 30 is defined by "B" and is ideally in the range of approximately 0.005 to 0.010 inches. In any event, as set forth above, the preferably operable longitudinal dimension of the entire passage 22 is in the range of 0.015 inches to 0.025 inches.

Further structural features of the terminal passage 22 is that the linear portion 28 has a substantially consistent diameter along its length thereby giving it a linear as versus a tapered configuration. The first portion 28 has a preferred diameter of 0.020 inches. The transverse dimension of the linear first portion 28 is greater than the linear dimension of the second portion 30. The second portion 30 has a preferred diameter of 0.030 inches. This stepped configuration of the terminal orifice passage 22 is utilized for adequate spray pattern control in realizing the desired or predetermined pattern dependent upon the product being utilized. Directional arrows 34 represent the pattern of actual product being dispensed from the terminal orifice passage 22.

Another important structural feature of the present invention is the specific disposition of the terminal orifice passage 22 in interconnecting contiguous relation between the expansion chamber 20 and the exterior of the body 14. This specific disposition defines the exclusive path of travel as the product is being dispensed from the chamber 20 to the exterior of the body 14 of button 10.

Due to the shortened longitudinal dimension of the terminal orifice passage 22, a structural configuration of the button body 14 includes face portion 36 being recessed inwardly from the outer exterior surface 38 of the button 10. This recessed configuration may further be defined by a planar base 40 and an outwardly tapering flange portion of the recess face 42. In order to avoid impingement on the button as the product issues from the terminal orifice 22, the surrounding lip member 44 must be spaced a sufficient distance from the terminal orifice passage 22 as to avoid such impingement, dependent upon the desired pattern which the product will assume upon issuance from the distal end generally indicated as 46 of the terminal orifice passage 22.

In operation, depression of the valve button 10 and, more specifically, the button body 14, causes an opening of the valve assembly (not shown) associated with the aerosol dispenser 12. This causes product to flow through stem 18 into the expansion chamber 20. The enlarged size and configuration of the expansion chamber 20 causes "flash" of the propellant which is maintained along with the product in the aerosol dispenser 12. The term "flash" is used to describe the immediate and rapid evaporation of the propellant as it enters and expands into the chamber 20. This evaporation of the propellant on the interior of the button allows maintenance of the desired temperature of the product and prevents the product's temperature being lowered to an undesirable degree upon being dispensed. The disposition of the terminal orifice passage 22 and its specific shortened longitudinal dimension allows for dispensing of the product immediately subsequent to the evaporation of the propellant. This in turn allows a spray pattern having the desired characteristics including the prevention of an undesirable lower temperature. The resultant spray pattern is wider and less dense due to the rapid "flashing" of the propellant.

In the preferred embodiment of the present invention, the button body 14 is formed into an integral one piece unit wherein its structure lends it specifically applicable to the dispensing of a powder-like product or alternatively, an alcohol based product. It should be noted however, that the structure of the subject valve button is not intended to be limited to the dispensing with the type product set forth above.

The specific examples of length and diameter of the first and second portions 28 and 30 of the terminal orifice 22 have been found to be satisfactory for spraying powders, anti-perspirants and water based air fresheners. In these applications, fine breakup is required of the button. Heretofore, a two piece button was the standard of the industry for powder and anti-perspirants.

The one piece buttons of the prior art excessively reduced the temperature of the product spray, causing dissatisfaction to the user. The one piece buttons of the prior art which were able to spray without excessively reducing the temperature of the product did not have the capability of breaking up the product into fine particles.

This invention has superior performance to the prior standard of the industry and may be manufactured at aproximately one-half the cost. This represents a savings of hundreds of thousands of dollars to some manufacturers of aerosol products.

The invention not only provides a superior breakup of the product, but also results in a temperature as warm or warmer than the standard two-piece button of the industry. In actual testing, it was found that the product temperature was 0.3° F. warmer than the industrial standard two-piece button.

The relationship between the first and second portions 28 and 30 produces this superior performance. More specifically, the specific ratios of length and diameter of the first and second portions 28 and 30 contribute to the performance of the invention. The first portion 28 is smaller in diameter than the second portion 30. Preferably, first portion 28 is two-thirds the diameter of second portion 30. The length of the first portion 28 is less than the diameter of the first portion 28. The length of the second portion 30 is substantially less than the diameter of the second portion 30. The length of the second portion 30 is preferably less than one-third of the diameter of the second portion 30. The length of the second portion 30 is preferably less than one-half the length of the first portion 28.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. An integral valve button of the type primarily designed to dispense a product from an aerosol dispenser, having a propellant, said valve button comprising, in combination:

a button body mounted in product dispensing disposition relative to the aerosol dispenser;

said button body comprising interior side wall means extending generally along an axis of said button body defining an expansion chamber formed therein in fluid communication with the interior of the aerosol dispenser;

terminal orifice means formed in said button body in fluid communication between said side wall means of said expansion chamber and the exterior of said button body to which the product is dispensed;

said terminal orifice means comprising a passage disposed contiguous to the said expansion chamber and defining the main path of travel of said product from said expansion chamber to the exterior of said button body;

said expansion chamber comprising a substantially enlarged interior configuration and being disposed in surrounding relation to a communicating end of said passage and being of a volume sufficient to enable evaporation of propellant in said expansion chamber upon dispensing the product and the propellant from the aerosol dispenser;

said passage having a substantially short length relative to said expansion chamber enabling substantially immediate dispensing of the product from the valve button subsequent to the evaporation of the propellant in said expansion chamber;

said passage comprising a first portion having a continuous length defined by a substantially consistent diameter and disposed contiguous to said expansion chamber;

said passage further comprising a second stepped portion disposed contiguous said first passage portion and exterior of said body;

said stepped configuration of said second portion being at least partially defined by a diameter of larger dimension and a length of less dimension than the respective dimensions of said first passage portion; and said first passage portion having a longitudinal dimension less than the diameter of said first passage portion.

2. A valve button as in claim 1 wherein said expansion chamber comprises a top portion having a dome shaped configuration, said top portion disposed in substantially spaced relation to the communicating end of said passage.

3. A valve button as in claim 1 wherein said button body comprises a face portion disposed contiguous to the distal end of said terminal orifice passage, said face portion further disposed in recessed relation to the remaining exterior side wall surface of said button.

4. A valve button as in claim 3 wherein said face portion is surrounded by a projecting lip integrally formed into said body and disposed about the periphery of said face portion, said face portion having a diameter of sufficient dimension to avoid impingement of product on said surrounding lip portion.

5. A valve button as in claim 1, wherein said first passage portion is defined by a longitudinal dimension from 0.010 inches to 0.015 inches.

6. A valve button as in claim 5 wherein said first passage portion has a diameter of approximately 0.020 inches.

7. A valve button as in claim 1, wherein said second passage portion is defined by a longtitudinal dimension from 0.005 inches to 0.010 inches.

8. A valve button as in claim 7, wherein said second passage portion has a diameter of approximately 0.030 inches.

9. A valve button as in claim 1 wherein said diameter of said first passage portion is approximately two-thirds of said second passage portion.

10. A valve button as in claim 1 wherein said longitudinal dimension of said second passage portion is less than one-half the longitudinal dimension of said first passage portion.

11. An integral valve button of the type primarily designed to dispense a product from an aerosol dispenser, having a propellant, said valve button comprising, in combination:

a button body mounted in product dispensing disposition relative to the aerosol dispenser;

said button body comprising interior side wall means extending generally along an axis of said button body defining an expansion chamber formed therein in fluid communication with the interior of the aerosol dispenser;

terminal orifice means formed in said button body in fluid communication between said side wall means of said expansion chamber and the exterior of said button body to which the product is dispensed;

said terminal orifice means comprising a passage disposed contiguous to the said expansion chamber and defining the exclusive path of travel of said product from said expansion chamber to the exterior of said button body;

said expansion chamber comprising an enlarged interior configuration being of a volume sufficient to enable evaporation of propellant in said expansion chamber upon dispensing the product and the propellant from the aerosol dispenser;

said passage having a first passage portion disposed contiguous to said expansion chamber and a second passage portion disposed contiguous to said first passage portion and the exterior of said body;

said first passage portion having a substantially short length relative to said expansion chamber enabling substantially immediate dispensing of the product from the valve button subsequent to the evaporation of the propellant in said expansion chamber;

said second passage portion having a diameter greater than one and one-half times the diameter of said first passage portion and with the longitudinal dimension of said second passage portion being less than one-half the longitudinal dimension of said first passage portion to control the spray pattern of the product; and said first passage portion having a longitudinal dimension less than the diameter of said first passage portion.

* * * * *